US007464522B2

(12) United States Patent
Higer et al.

(10) Patent No.: US 7,464,522 B2
(45) **Date of Patent: *Dec. 16, 2008**

(54) VACUUM PACKAGING APPLIANCE

(75) Inventors: Landen Higer, Alameda, CA (US); Charles Wade Albritton, Hercules, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/446,937

(22) Filed: Jun. 5, 2006

(65) Prior Publication Data

US 2006/0218885 A1 Oct. 5, 2006

Related U.S. Application Data

(63) Continuation of application No. 10/909,971, filed on Jul. 30, 2004, now Pat. No. 7,200,974.

(60) Provisional application No. 60/492,035, filed on Jul. 31, 2003, provisional application No. 60/492,090, filed on Jul. 31, 2003.

(51) Int. Cl.
*B65B 31/02* (2006.01)

(52) U.S. Cl. ..... 53/512; 53/405; 53/434; 53/84

(58) Field of Classification Search ..... 53/79, 53/84, 85, 86, 374.8, 375.6, 512, 434, 432, 53/510, 405, 426; 312/324, 325; 426/404
See application file for complete search history.

(56) References Cited

U.S. PATENT DOCUMENTS

| | | | |
|---|---|---|---|
| 1,143,579 | A | 6/1915 | Denhard |
| 1,346,435 | A | 7/1920 | Worster |
| 1,521,203 | A | 12/1924 | Roehnig |
| 2,079,069 | A | 5/1937 | Johnson |
| 2,270,332 | A | 1/1942 | Osborn, Jr. |
| 2,270,469 | A | 1/1942 | Osborn, Jr. |
| 2,319,011 | A | 5/1943 | Meredith |
| 2,354,423 | A | 7/1944 | Rosenberger |
| 2,421,149 | A | 5/1947 | Hard et al. |
| 2,506,362 | A | 5/1950 | Hofmann |

(Continued)

FOREIGN PATENT DOCUMENTS

| | | | |
|---|---|---|---|
| DE | 3632723 | A1 | 3/1988 |

(Continued)

OTHER PUBLICATIONS

"Vacuum Seal-A-Meal Instructions and Recipe Book," by Dazey.

(Continued)

*Primary Examiner*—Paul R Durand
(74) *Attorney, Agent, or Firm*—Hoffmann & Baron, LLP

(57) ABSTRACT

An apparatus for vacuum sealing a storage bag including a base and a receptacle component for receiving an end of a storage bag. The receptacle including a vacuum chamber for accepting an open end of the bag. The receptacle is pivotally secured to the base and rotatable relative thereto between a first operating position and a second storage position. A sealing device is disposed on the receptacle for sealing the open end of the bag.

24 Claims, 10 Drawing Sheets

U.S. PATENT DOCUMENTS

| | | | | | |
|---|---|---|---|---|---|
| 2,568,226 | A | | 9/1951 | Drake | |
| 2,617,304 | A | | 11/1952 | Conover | |
| 2,672,268 | A | | 3/1954 | Bower | |
| 2,749,686 | A | | 6/1956 | Lorenz et al. | |
| 2,755,952 | A | | 7/1956 | Ringen | |
| 2,778,171 | A | | 1/1957 | Taunton | |
| 2,778,177 | A | | 1/1957 | Mahaffy et al. | |
| 2,838,894 | A | | 6/1958 | Paikens et al. | |
| 2,899,786 | A | | 8/1959 | Harker | |
| 2,963,838 | A | | 12/1960 | Harrison et al. | |
| 2,991,609 | A | | 7/1961 | Randall | |
| 3,038,283 | A | | 6/1962 | Unger | |
| 3,055,536 | A | | 9/1962 | Dieny | |
| 3,064,358 | A | | 11/1962 | Giuffre | |
| 3,148,269 | A | | 9/1964 | Van Hartesveldt et al. | |
| 3,234,072 | A | | 2/1966 | Dreeben | |
| 3,320,097 | A | | 5/1967 | Sugalski | |
| 3,464,256 | A | | 9/1969 | Lloyd | |
| 3,516,223 | A | | 6/1970 | Andersen et al. | |
| 3,532,323 | A | * | 10/1970 | Uhen | 254/126 |
| 3,552,816 | A | * | 1/1971 | Wolanin | 312/8.4 |
| 3,589,098 | A | | 6/1971 | Schainhotz et al. | |
| 3,688,463 | A | | 9/1972 | Titchenal | |
| 3,699,742 | A | | 10/1972 | Giraudi | |
| 3,788,651 | A | | 1/1974 | Brown et al. | |
| 3,800,503 | A | | 4/1974 | Maki | |
| 3,832,824 | A | | 9/1974 | Burrell | |
| 3,851,437 | A | | 12/1974 | Waldrop et al. | |
| 3,858,750 | A | | 1/1975 | Grall | |
| 3,866,390 | A | | 2/1975 | Moreland, II et al. | |
| 3,928,938 | A | | 12/1975 | Burrell | |
| 3,962,847 | A | | 6/1976 | Trudel | |
| 3,965,646 | A | | 6/1976 | Hawkins | |
| 4,006,329 | A | | 2/1977 | Hellman et al. | |
| 4,008,601 | A | | 2/1977 | Woods | |
| 4,021,290 | A | | 5/1977 | Smith | |
| 4,059,113 | A | | 11/1977 | Beinsen et al. | |
| 4,105,491 | A | | 8/1978 | Haase et al. | |
| 4,106,661 | A | | 8/1978 | Hunt | |
| 4,143,787 | A | | 3/1979 | Walker | |
| RE30,045 | E | | 7/1979 | Greene | |
| 4,164,111 | A | | 8/1979 | Di Bernardo | |
| 4,179,862 | A | | 12/1979 | Landolt | |
| 4,208,902 | A | | 6/1980 | Kim et al. | |
| 4,221,101 | A | | 9/1980 | Woods | |
| 4,222,276 | A | | 9/1980 | DeRogatis | |
| 4,330,975 | A | * | 5/1982 | Kakiuchi | 53/79 |
| 4,371,175 | A | | 2/1983 | Van Dyk, Jr. | |
| 4,372,096 | A | | 2/1983 | Baum | |
| 4,471,599 | A | | 9/1984 | Mugnai | |
| 4,541,224 | A | | 9/1985 | Mugnai | |
| 4,545,177 | A | * | 10/1985 | Day | 53/434 |
| 4,549,387 | A | | 10/1985 | Marshall et al. | |
| 4,561,925 | A | * | 12/1985 | Skerjanec et al. | 53/374.8 |
| 4,578,928 | A | | 4/1986 | Andre et al. | |
| 4,581,764 | A | | 4/1986 | Plock et al. | |
| 4,583,347 | A | | 4/1986 | Nielsen | |
| 4,620,408 | A | | 11/1986 | Parnes | |
| 4,631,512 | A | | 12/1986 | Hishiki et al. | |
| 4,641,482 | A | | 2/1987 | Metz | |
| 4,756,140 | A | | 7/1988 | Gannon | |
| 4,848,244 | A | * | 7/1989 | Bennett | 108/38 |
| 4,860,523 | A | | 8/1989 | Teteishi et al. | |
| 4,909,014 | A | | 3/1990 | Kobayashi et al. | |
| 4,922,686 | A | | 5/1990 | Segota | |
| 4,928,829 | A | | 5/1990 | Di Bernardo | |
| 4,941,310 | A | * | 7/1990 | Kristen | 53/512 |
| 5,012,615 | A | | 5/1991 | Piccinini et al. | |
| 5,048,269 | A | | 9/1991 | Deni | |
| 5,056,292 | A | | 10/1991 | Natterer | |
| 5,177,937 | A | | 1/1993 | Alden | |
| 5,209,044 | A | | 5/1993 | D'Addario et al. | |
| 5,232,016 | A | | 8/1993 | Chun | |
| 5,239,808 | A | * | 8/1993 | Wells et al. | 53/512 |
| 5,352,323 | A | | 10/1994 | Chi | |
| RE34,929 | E | | 5/1995 | Kristen | |
| 5,450,963 | A | | 9/1995 | Carson | |
| 5,461,901 | A | | 10/1995 | Ottestad | |
| 5,465,857 | A | | 11/1995 | Yang | |
| 5,515,773 | A | | 5/1996 | Bullard | |
| 5,544,752 | A | | 8/1996 | Cox | |
| 5,551,213 | A | | 9/1996 | Koelsch et al. | |
| 5,608,167 | A | | 3/1997 | Hale et al. | |
| 5,617,893 | A | | 4/1997 | Webster | |
| 5,620,098 | A | | 4/1997 | Boos et al. | |
| 5,638,664 | A | | 6/1997 | Levsen et al. | |
| 5,655,357 | A | | 8/1997 | Kristen | |
| 5,682,727 | A | | 11/1997 | Harte et al. | |
| D389,847 | S | | 1/1998 | Huang | |
| 5,712,553 | A | | 1/1998 | Hallberg | |
| 5,735,395 | A | | 4/1998 | Lo | |
| 5,765,608 | A | | 6/1998 | Kristen | |
| 5,784,857 | A | | 7/1998 | Ford et al. | |
| 5,784,862 | A | * | 7/1998 | Germano | 53/512 |
| 5,803,282 | A | | 9/1998 | Chen et al. | |
| 5,825,974 | A | | 10/1998 | Hutton | |
| 5,889,664 | A | | 3/1999 | Ben-David et al. | |
| 5,893,822 | A | * | 4/1999 | Deni et al. | 53/512 |
| 5,954,196 | A | | 9/1999 | Lin | |
| 6,058,998 | A | | 5/2000 | Kristen | |
| 6,070,397 | A | | 6/2000 | Bachhuber | |
| 6,072,172 | A | | 6/2000 | Duggan et al. | |
| 6,085,906 | A | | 7/2000 | Lambert | |
| 6,124,558 | A | | 9/2000 | Baumeister et al. | |
| 6,161,716 | A | | 12/2000 | Oberhofer et al. | |
| 6,256,968 | B1 | * | 7/2001 | Kristen | 53/512 |
| 6,328,897 | B1 | | 12/2001 | Leung | |
| 6,441,323 | B1 | * | 8/2002 | Montagnino et al. | 177/126 |
| 6,467,242 | B1 | | 10/2002 | Huang | |
| 6,481,180 | B1 | | 11/2002 | Takahashi et al. | |
| 6,520,071 | B1 | | 2/2003 | Lanza | |
| 6,619,493 | B2 | | 9/2003 | Yang | |
| 6,694,710 | B2 | | 2/2004 | Wang | |
| 6,789,690 | B2 | | 9/2004 | Nieh et al. | |
| 6,792,736 | B1 | | 9/2004 | Takahashi et al. | |
| 6,827,243 | B1 | | 12/2004 | Nuzzolese | |
| 7,003,928 | B2 | * | 2/2006 | Patterson et al. | 53/405 |
| 7,021,027 | B2 | | 4/2006 | Higer | |
| 7,076,929 | B2 | | 7/2006 | Patterson et al. | |
| 7,131,250 | B2 | | 11/2006 | Kahn et al. | |
| 7,200,974 | B2 | * | 4/2007 | Higer et al. | 53/86 |
| 7,204,067 | B2 | | 4/2007 | Baptista | |
| 2003/0000180 | A1 | | 1/2003 | Singer | |
| 2003/0103881 | A1 | | 6/2003 | Lane et al. | |
| 2003/0140603 | A1 | | 7/2003 | Krasenics et al. | |
| 2003/0159405 | A1 | | 8/2003 | Knowlton et al. | |
| 2004/0031245 | A1 | | 2/2004 | Kingeter et al. | |
| 2004/0060262 | A1 | | 4/2004 | Harges et al. | |
| 2004/0099332 | A1 | * | 5/2004 | Kieck | 141/65 |
| 2004/0134359 | A1 | * | 7/2004 | Schiro' et al. | 99/472 |
| 2005/0011166 | A1 | | 1/2005 | Germano | |
| 2005/0022473 | A1 | | 2/2005 | Small et al. | |
| 2005/0022474 | A1 | | 2/2005 | Albritton et al. | |
| 2005/0028494 | A1 | | 2/2005 | Higer et al. | |
| 2005/0039420 | A1 | | 2/2005 | Albritton et al. | |
| 2005/0050856 | A1 | | 3/2005 | Baptista | |
| 2005/0108990 | A1 | | 5/2005 | Kahn et al. | |
| 2006/0123737 | A1 | | 6/2006 | Higer | |
| 2006/0230711 | A1 | | 10/2006 | Higer et al. | |
| 2007/0033907 | A1 | | 2/2007 | Higer et al. | |
| 2007/0068120 | A1 | | 3/2007 | Kahn et al. | |
| 2007/0193230 | A1 | | 8/2007 | Baptista | |

2007/0204561 A1 9/2007 Kahn et al.

FOREIGN PATENT DOCUMENTS

| | | | |
|---|---|---|---|
| EP | 0 723 915 | B1 | 9/1999 |
| EP | 1053945 | A1 | 11/2000 |
| EP | 1 149 768 | A1 | 10/2001 |
| EP | 1 433 719 | A1 | 6/2004 |
| GB | 2211161 | A | 6/1989 |
| IT | 1 278 835 | | 11/1997 |
| JP | A-S62-287823 | | 12/1987 |
| JP | U-S63-079307 | | 5/1988 |
| JP | 63-307023 | | 12/1988 |
| JP | 05-10211 | | 2/1993 |
| JP | 2000-043818 | | 2/2000 |
| JP | A-2002-308215 | | 10/2002 |
| WO | WO 99/48758 | | 9/1999 |
| WO | WO 00/71422 | | 11/2000 |
| WO | WO 02/10017 | A1 | 2/2002 |
| WO | WO 03/064261 | A1 | 8/2003 |
| WO | WO 2004/048203 | | 6/2004 |
| WO | WO 2004/065222 | A1 | 8/2004 |

OTHER PUBLICATIONS

"Foodsaver, The First Commercial-Quality Vacuum Packaging System for the Home," Deanna DeLong, 1988.
"Foodsaver, The First Commercial-Quality Vacuum Packaging System for the Home," Deanna DeLong, 1987.
Magic Vac® Champion Commercial Quality Vacuum Sealer Model #1750 © 2000, Instruction Manuel, Deni, pp. 1-15.
U.S. Appl. No. 11/385,113, filed Mar. 20, 2006 (Corresponds to U.S. Publication No. 20060230711).

* cited by examiner

VACUUM PACKAGING APPLIANCE

CROSS-REFERENCE TO RELATED APPLICATIONS

This application is a continuation of U.S. patent application Ser. No. 10/909,971, filed on Jul. 30, 2004 now U.S. Pat. No. 7,200,974, which claims priority to U.S. Provisional Application Nos. 60/492,035, filed on Jul. 31, 2003, and 60/492,090 filed Jul. 31, 2003, all three aforementioned applications are herein incorporated by reference in their entireties.

FIELD OF THE INVENTION

The present invention generally relates to vacuum packaging appliances. More particularly, the invention is directed to a vacuum packaging appliance that can be conveniently stored.

BACKGROUND OF THE INVENTION

Vacuum packaging is a process for removing oxygen and other gases from containers holding food and other products that deteriorate in the presence of gases. For example, food spoilage can occur due to oxidation. Thus, vacuum packaging can extend the life of products that deteriorate in the presence of gases by removing nearly all of the gases in a sealed container in which such products are stored.

While vacuum packaging appliances are very useful, as with most appliances, appliance components suffer from wear and tear. For example, those movable components that are frequently handled are prone to fall into disrepair. Further, such appliances can be unwieldy and occupy a good deal of valuable counter space and/or storage space.

In addition, vacuum sealing appliances typically include a lid that is closed on the open end of a bag to isolate the bag end from ambient air. Such isolation is typically achieved by the use of resilient gaskets on the lid and the housing portion covered by the lid. Deforming the gaskets can take some effort for a user, who must force the lid downwardly until it is properly latched.

Accordingly, there is a need for vacuum packaging appliances that are configured for reduced wear and tear and for convenient storage. There is further a need for vacuum packaging appliances having a mechanism for easily securing the lid and providing adequate sealing.

SUMMARY OF THE INVENTION

It is an advantage of the present invention to provide a vacuum sealing appliance which is easy to store.

It is also an advantage of the present invention to provide a vacuum sealing appliance that can be rotated between an operating position and a storage position.

It is further an advantage of the present invention to provide a vacuum sealing appliance having a lid that can be selectively secured in a closed position.

In the efficient attainment of these and other advantages, the present invention provides an apparatus for vacuum sealing a storage bag including a base and a receptacle component for receiving an end of a storage bag. The receptacle including a vacuum chamber for accepting an open end of the bag. The receptacle is pivotally secured to the base and rotatable relative thereto between a first operating position and a second storage position. A sealing device is disposed on the receptacle for sealing the open end of the bag.

The present invention may also provide a receptacle that may rotate about a pivot axis which runs along the length of the base. The receptacle may extend outwardly from the base in a generally horizontal direction when the receptacle is in the first position, and extend in a generally vertical direction when the receptacle is in the second position.

The present invention may further provide a vacuum chamber that includes a vacuum channel adapted to communicate with a vacuum generating device for receiving an open end of the storage bag. The vacuum channel may runs along a length of the receptacle.

The present invention may still further provide a receptacle having a lid movable between an open and closed position, and a latch for selectively securing the lid in the closed position. The receptacle may further includes a bag storage compartment adapted to hold a roll of bag material.

BRIEF DESCRIPTION OF THE DRAWINGS

The present invention is illustrated by way of example, and not by way of limitation.

DETAILED DESCRIPTION OF THE PREFERRED EMBODIMENTS

The present invention includes a vacuum sealing appliance having improved service life. The present invention also provides a vacuum sealing appliance which can be easily stored by pivoting between a first operating position and a second storage position.

According to certain embodiments the vacuum appliance is designed to be lidless in order to reduce the number of movable parts and thus effectively reduce wear and tear of the appliance. Further, the lidless design described herein allows for convenient placement in the operational environment of the appliance. For example, a lidless vacuum appliance can be affixed under a counter or cabinet so as to save counter-top space as well as allow for convenient access during operational mode. When such an appliance is not is use, there is no need to find storage space for the appliance since the appliance is affixed in a location that is largely non-intrusive.

Figure 1:
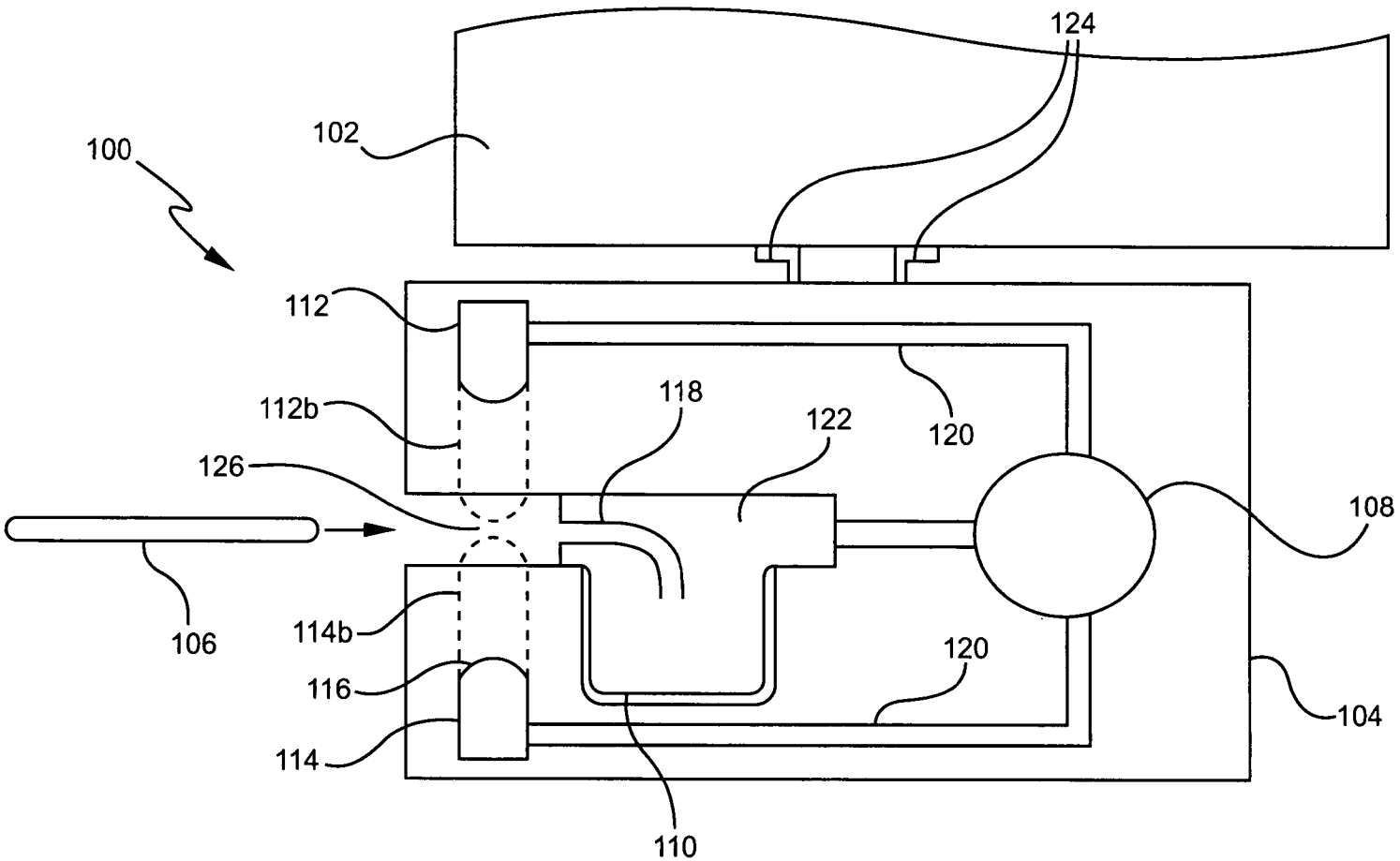
FIG. 1 is a cross-sectional view of a lidless vacuum appliance, according to certain embodiments of the present invention.

FIG. 1 is a cross-sectional view of a lidless vacuum appliance, according to certain embodiments. View 100 shows a side view of cabinet or counter 102 and lidless vacuum appliance 104 and packaging bag 106. Lidless vacuum appliance 104 is affixed under the counter 102 by brackets 124. Lidless vacuum appliance 104 can be adapted for affixing to any supporting structure and thus may vary from implementation to implementation. For example, lidless vacuum appliance 104 can be affixed to a wall, an over-hang, or a boom that is either movable or fixed. FIG. 1 shows the lidless vacuum appliance 104 including a slot 126, a guide track 118, a drip tray 110, a vacuum chamber 122, a sealing element 116, bladders 112 and 114, and motor components 108. Bladders 112 and 114 are operationally connected to motor components 108 by connectivity components 120. Examples of connectivity components 120 are pipes or hoses. The lidless vacuum appliance also includes the attendant circuitry and other components (not shown) for operating the vacuum and sealing processes.

In order to vacuum seal packaging bag 106, packaging bag 106 is inserted in slot 126 of lidless vacuum appliance. Guide track 118 guides the mouth of packaging bag 106 into drip tray 110. Drip tray 110 is for catching any fluids or other particles that might fall out of the bag during the vacuum packaging process. Before the vacuum packaging process begins, bladders 112 and 114 each inflate in order to clamp onto packaging bag 106 to form an air-tight seal such that air does not flow through slot 126 past the bladders into the vacuum chamber. Bladders 112 and 114 are inflated by an intake of air through connectivity components 120 caused by operation of motor components 108. Phantom bladders 112*b* and 114*b* show the inflated position of bladders 112 and 114. When an airtight seal is formed, the vacuum packaging process can begin by evacuating gases from the vacuum chamber 122 and from the interior of packaging bag 106. When packaging bag 106 is sufficiently evacuated of gases, heating element 116 can be activated for forming a heat seal on packaging bag 106. Such a heat seal prevents air from re-entering the bag. After packaging bag 106 is heat sealed, bladders 112 and 114 can be deflated to allow packaging bag 106 to be extricated from the lidless vacuuming appliance 104.

Figure 2:
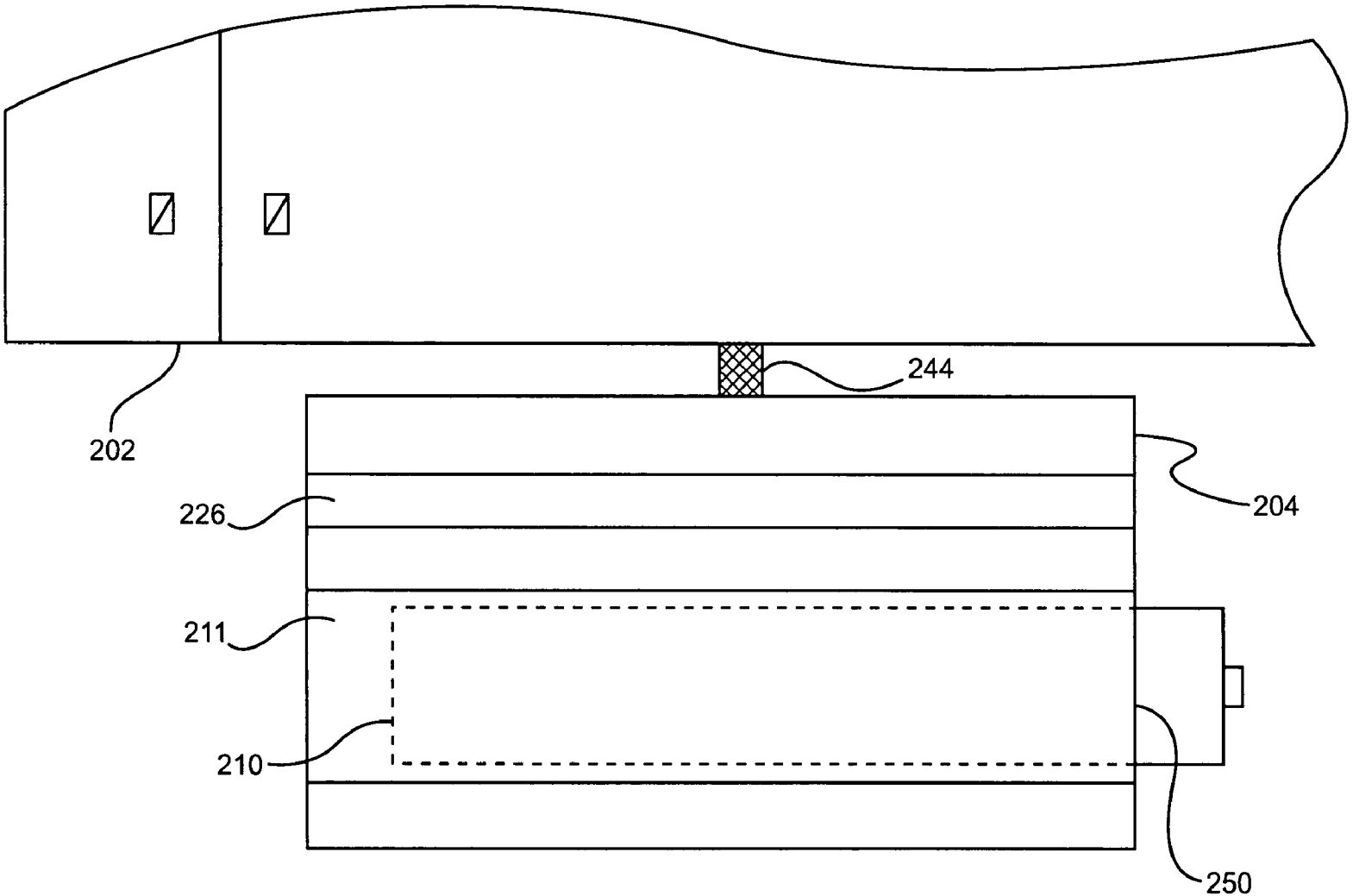
FIG. 2 is a frontal view of a lidless vacuum appliance, according to certain other embodiments of the present invention.

According to certain embodiments, drip tray 110 can be detached from the lidless vacuuming appliance 104 conveniently through an opening on the side of the appliance as described herein with reference to FIG. 2. FIG. 2 is a frontal view of a lidless vacuum appliance, according to certain other embodiments. In FIG. 2, a lidless vacuuming appliance 204 is affixed under a cabinet or counter 202 by one or more screws 244. FIG. 2 shows slot 226 through which a packaging bag can be inserted for evacuating gases from the packaging bag. FIG. 2 also shows a cavity 211 where drip tray 210 resides in lidless vacuum appliance 204. Drip tray 210 can be extricated from the appliance by sliding drip tray 210 out from lidless vacuum appliance 204 through opening 250. Opening 250 is sealed airtight when drip tray 210 is completely inserted into cavity 211.

Figure 3:
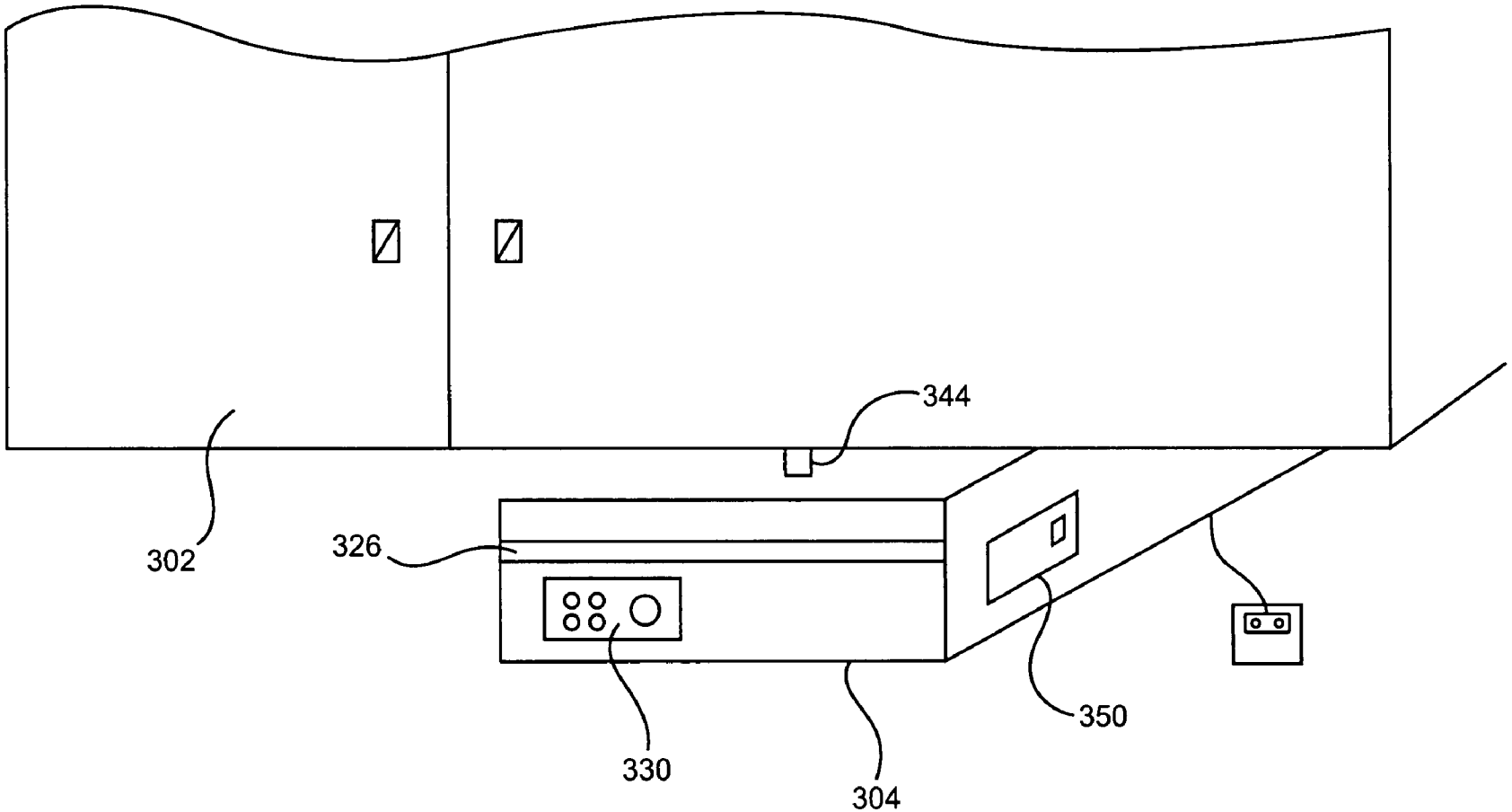
FIG. 3 is a partial perspective view of a lidless vacuum appliance that illustrates space-saving placement of the appliance.

FIG. 3 is a partial perspective view of a lidless vacuum appliance 304 that illustrates space-saving placement of the appliance. FIG. 3 shows that lidless vacuum appliance 304 is affixed under a cabinet or counter 302 by attachment 344. FIG. 3 also shows that lidless vacuum appliance 304 includes a slot 326, a control panel 330, and a side opening 350 (egress) through which the drip tray in the appliance can be extricated. According to certain embodiments, the lidless vacuum appliance 304 can include a pair of openings, one on either side of the appliance 304, either one of which can be used for extricating the drip tray.

Figure 4:
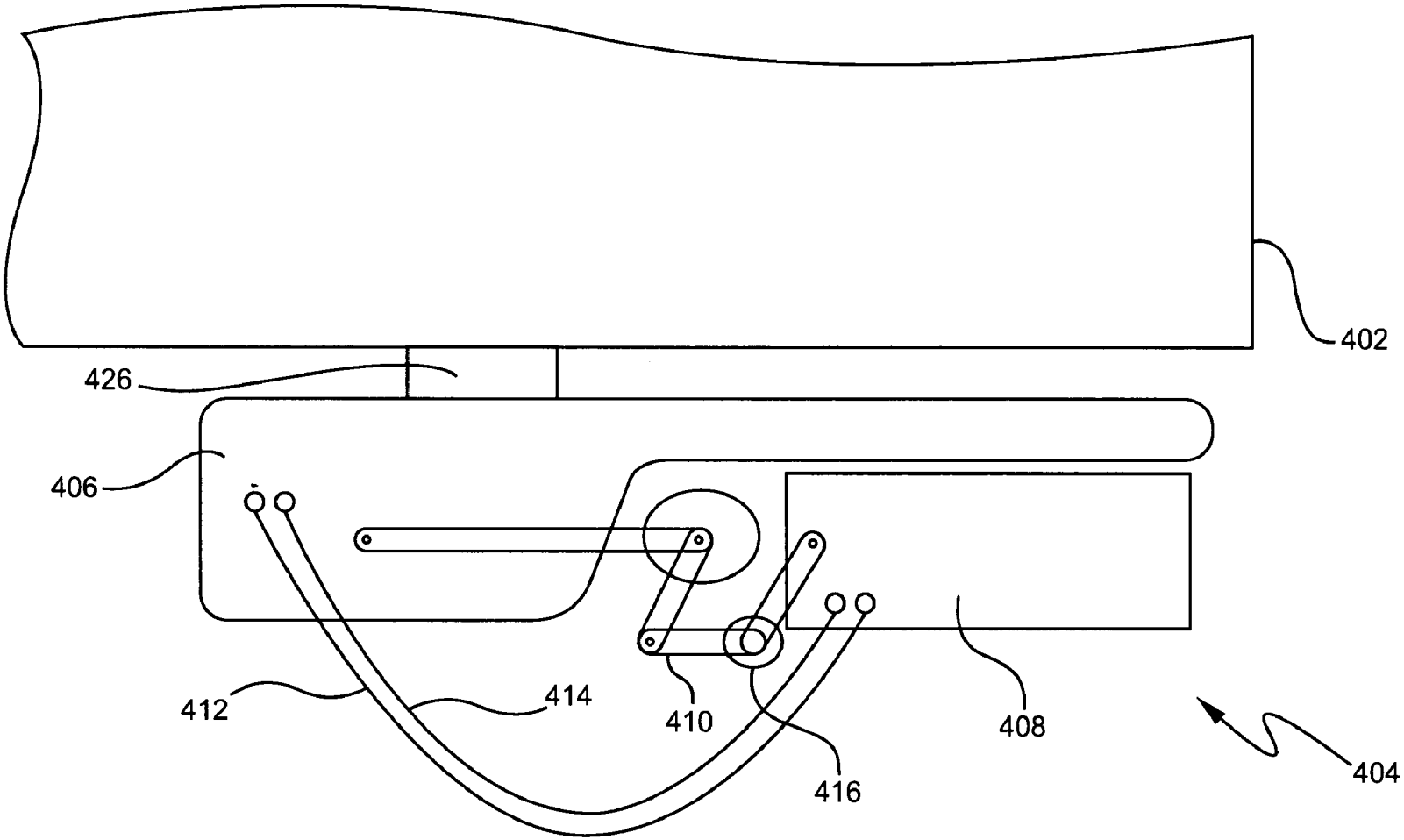
FIG. 4 is a side view of an under-cabinet or under-counter vacuum appliance in retracted storage mode.

FIG. 4 is a side view of an under-cabinet or under-counter vacuum appliance in retracted storage mode or position. In FIG. 4, lidless vacuum appliance 404 is affixed under cabinet 402 by an attachment 426. In FIG. 4, lidless vacuum appliance 404 is shown in a retracted storage mode as described herein. Lidless vacuum appliance 404 includes a fixed component 406 and a movable component 408, extension rods 410, electrical connection 414 and vacuum hose 412. Lidless vacuum appliance 404 can optionally include bag-roll 415 and bag-cutter 416. Fixed component 406 houses a vacuum motor (not shown) connected to a vacuum chamber (not shown) in movable component 408 via vacuum hose 412. Movable component 408 also houses a drip tray used for sealing a packaging bag. Vacuum hose 412 can also be used to inflate bladders in movable component 408 for sealing the vacuum chamber during an evacuation process. In FIG. 4, extension rods 410 are folded into a retracted position such that movable component 408 remains tucked under counter 402 and is in close proximity to fixed component 406.

Figure 5:
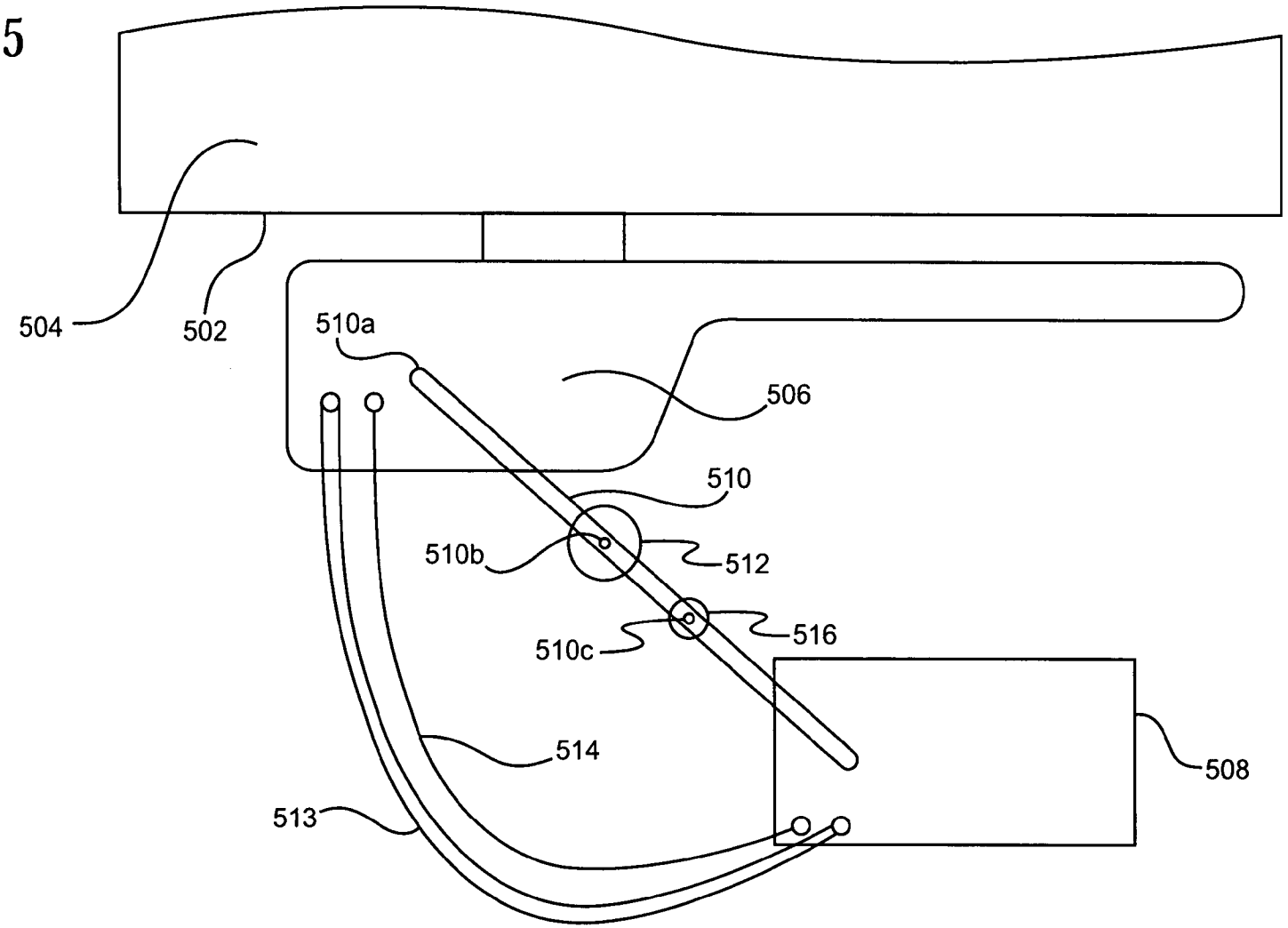
FIG. 5 is a side view of an under-cabinet or under-counter vacuum appliance in an extended configuration for operation.

FIG. 5 is a side view of an under-cabinet or under-counter vacuum appliance in an extended configuration for operation. In FIG. 5, movable component 508 of lidless vacuum appliance 504 is extended away from fixed component 506 of lidless vacuum appliance 504. Such an extension is made possible by unfolding extension rods 510. Extension rods 510 can also be pivoted about joints 510*a*, 510*b* and 510*c* in order to situate movable component 508 in a suitable position for operation. In the extended position, movable component 508 is conveniently located for ease of use. FIG. 5 also shows bag roll 512, bag cutter 516, electrical connection 514 and vacuum hose 513.

Figure 6B:
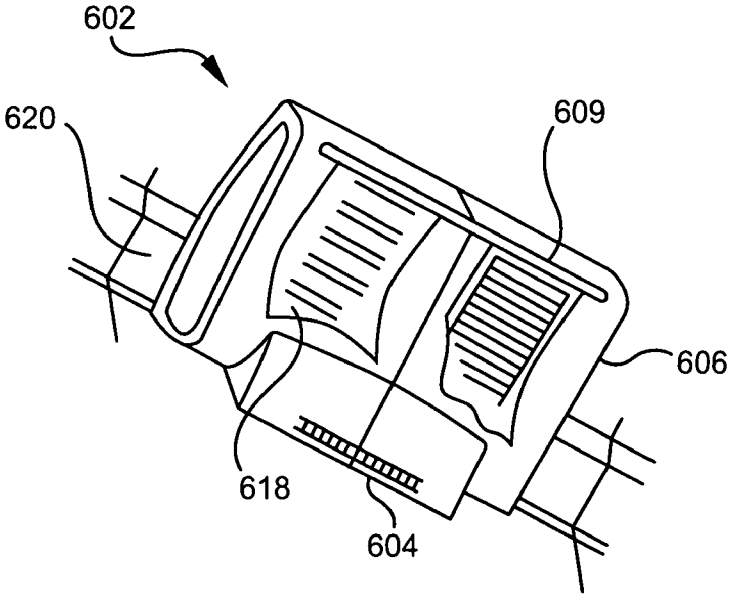
FIG. 6B is a perspective view of the vacuum appliance of FIG. 6A in storage position.
Figure 6A:
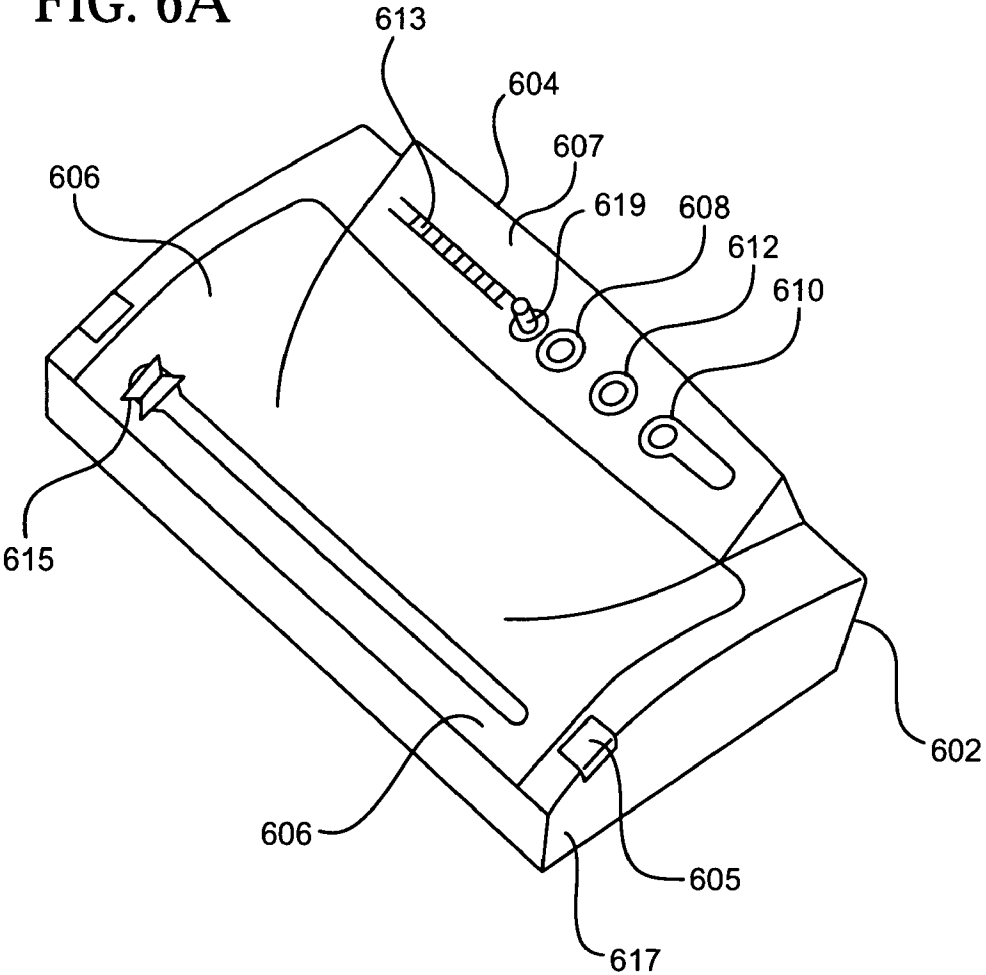
FIG. 6A is a perspective view of a further embodiment of a vacuum appliance in an operating position.

In an alternative embodiment, shown in FIGS. 6A-6B, the vacuum packaging apparatus provides space saving properties by rotating between a first operating position and a second stored position. Vacuum packaging apparatus 602 includes a base 604 and a receptacle 606 which is pivotable relative to the base. Pivotable receptacle 606 receives the packaging bag that is to be evacuated of gases when evacuation is desired. Stationary base 604 may include a vacuum pump (not shown), sealing mechanism (not shown) and controls (not shown) associated with the operation of the vacuum pump and sealing mechanism. Stationary base 604 may include a control panel 607 at the top frontal portion of the stationary base. Control panel 607 may include an accessory port 608 for use in removing gases from storage canisters. Control panel 607 may also include an instant seal button 610 to manually start sealing a storage bag, and a vacuum button 612 to start removing gases from storage bags or canisters.

The sealing function may be automatically activated when the lid of the movable receptacle component 606 is in the closed position over one end of a storage bag, which end is not in a vacuum channel of the vacuum packaging apparatus. When a storage bag is being evacuated through activation of the vacuuming function, the instant seal button 610 may be used to seal a storage bag before a complete vacuum is created in the storage bag. This feature is useful when vacuum packaging fragile items so that such items do not get crushed. In addition, control panel 607 may include indicator lights 613 to signal the start or completion of various processes such as the sealing process, vacuum process and/or machine re-programming when transitioning from one process to the next. Control panel 607 may optionally include an automatic On/Off button. The automatic On/Off button acts as a fail-safe mechanism to ensure that the heat sealing and or vacuum mechanisms are not unintentionally activated. Further, control panel 607 may optionally include a Cancel Button for canceling a given operation in progress.

Control panel 607 may also include sealing time adjustment knob 619 for controlling the heating element associated with the sealing mechanism. For example, the sealing time adjustment can be set to a first setting when storage bags are being sealed. The sealing time adjustment can be set to a second setting when canisters are being sealed. In the case of sealing canisters, there is no need for activating the heating element.

In certain embodiments, the vacuum operation for removing gases automatically starts when the lid of movable receptacle component is in the closed position. In such cases, control panel 607 may include an extended vacuum button. The extended vacuum button may be used to extend the vacuum time to ensure that the maximum amount of air is removed especially when using extra large storage canisters or bags.

The movable receptacle component 606 may include a compartment 617 with a lid 614. Compartment 617 includes a vacuum chamber. The vacuum chamber includes a vacuum channel that is in communication with the vacuum pump. Further, the vacuum chamber includes one or more gaskets for statically sealing the vacuum chamber when the lid 614 is in the closed position. Compartment 617 may include a storage bag cutter 615 integrated into lid 614. The compartment 617 may also contain a shelf mechanism for holding one or more rolls of storage bags. Furthermore, movable receptacle component 606 may include a latch 605 that automatically locks during the sealing and/or vacuuming operation. Latch 605 is released in order to pop lid 614 open.

FIG. 6B is an isometric view that illustrates the pivoting vacuum packaging apparatus of FIG. 6A in a pivoted configuration for convenient storage. In FIG. 6B, stationary base 604 of the vacuum packaging apparatus 602 may optionally be affixed to a wall or countertop back-splash 620. Movable receptacle component 604 may be pivoted up ("flipped-up") towards the wall, about a pivot axis that runs the length of stationary base 604.

Movable receptacle component 606 may optionally include an x-ray style strip 609 for holding notes and recipes 618. X-ray style strip 609 doubles as a foot when movable receptacle component 606 lies flat on the countertop surface during operation mode. The pivoted configuration as shown in FIG. 6B saves countertop space. Optionally, vacuum packaging apparatus 602 may include a mechanism that prevents operation of the vacuum packaging apparatus when the vacuum packaging apparatus is in the flipped-up position.

Figure 7B:
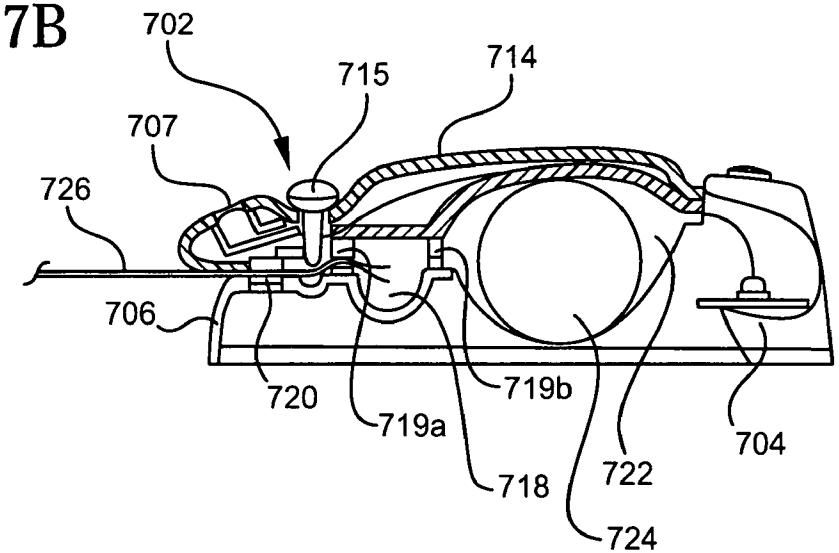
FIG. 7B is a cross-sectional view of the vacuum appliance of FIG. 7A taken along line B-B thereof.
Figure 7A:
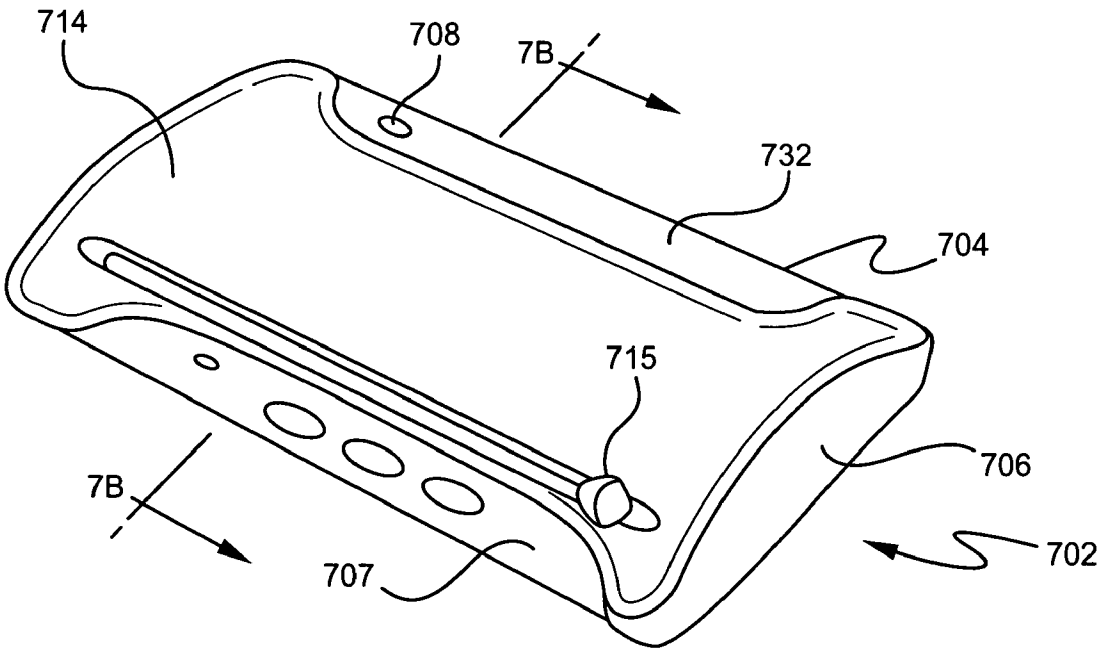
FIG. 7A is a perspective view of an alternative embodiment of a vacuum appliance.

FIGS. 7A-7B illustrate an alternative embodiment of a pivoting vacuum packaging apparatus 702 with a stationary base 704 and a pivotal receptacle 706 with control panel 707 on a lid 714. Vacuum packaging apparatus 702 is similar to vacuum packaging apparatus 602 of FIG. 6A. Thus, the description of stationary base 604, bag-cutting unit 615, and movable receptacle component 606 apply to stationary base 704, bag-cutting unit 715, and movable receptacle component 706, respectively. Similarly, movable receptacle component 706 is operable to be rotated about a pivot axis such that it can be flipped-up over the stationary base 704 for convenient space saving storage.

Vacuum packaging apparatus 702 further includes a vacuum channel or trough 718 running along the length of the receptacle 706. The front end of the bag 726 extends into the vacuum channel which is sealed by gaskets 719*a* and 719*b* surrounding the vacuum channel. The channel may be evacuated permitting air within the bag to be evacuated through the bag opening. After the bag is evacuated, the opening may be sealed by a heating strip 720 in a manner well known in the art. The receptacle 706 may also include a bag roll storage area 722 for holding a roll of bag material 724.

One of the differences between vacuum packaging apparatus 602 and vacuum packaging apparatus 702 is that the control panel 707 is on lid 714 rather than on a top frontal portion of stationary base 702. Further, accessory port 708 may be situated on an exposed lower housing 732.

Figure 8A:
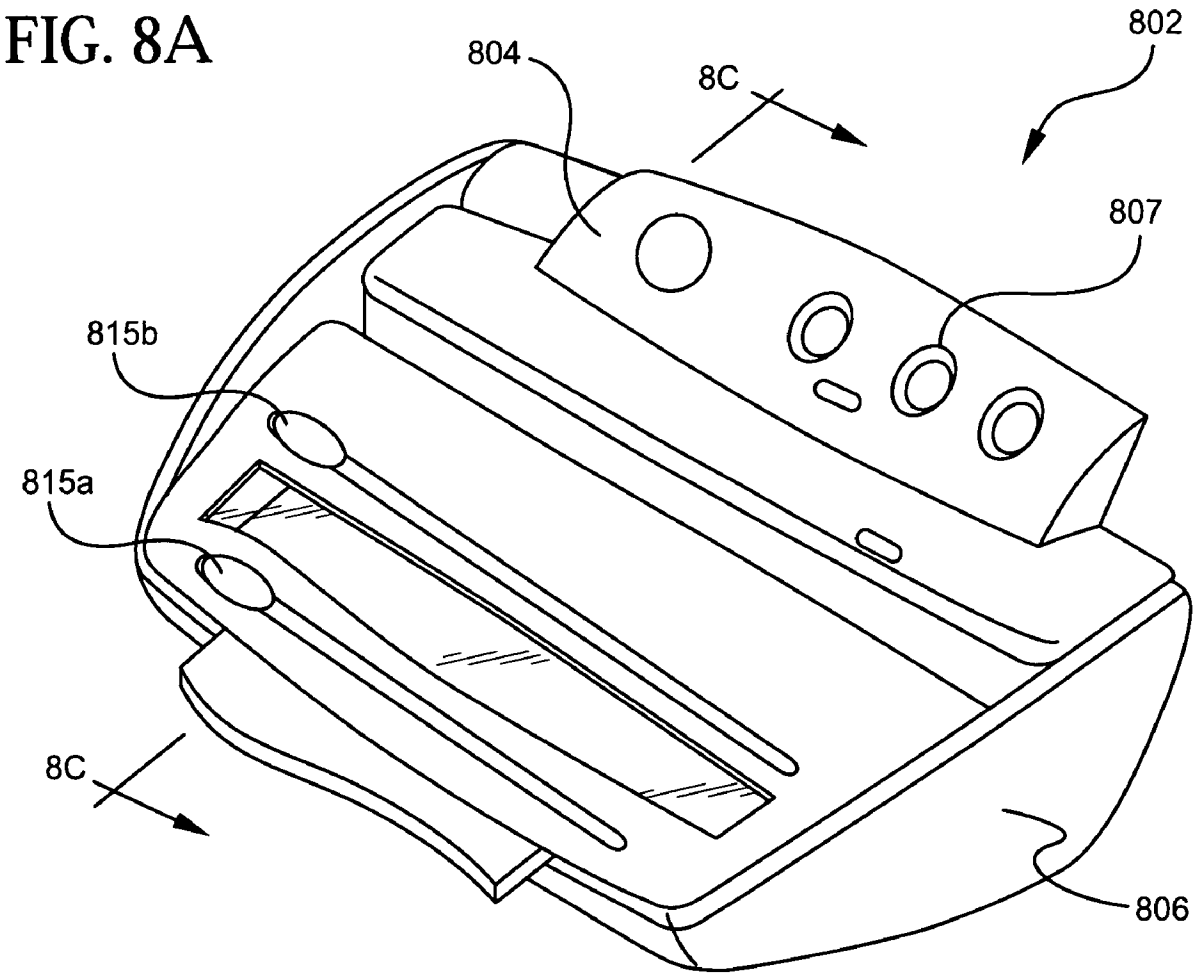
FIG. 8A is a perspective view of another alternative embodiment of a vacuum appliance.

FIG. 8A is an isometric view that illustrates certain embodiments of a pivoting vacuum packaging apparatus 802 with a dual bag roll shelf. Vacuum packaging apparatus 802 is similar to vacuum packaging apparatus 602 of FIG. 6A. Thus, the description of stationary base 604, control panel 607, and movable receptacle component 606 apply to stationary base 804, control panel 807, and movable receptacle component 806, respectively. Similarly, movable receptacle component 806 is operable to be flipped-up over the stationary base 804 (FIG. 8C) for convenient storage.

Figure 8C:
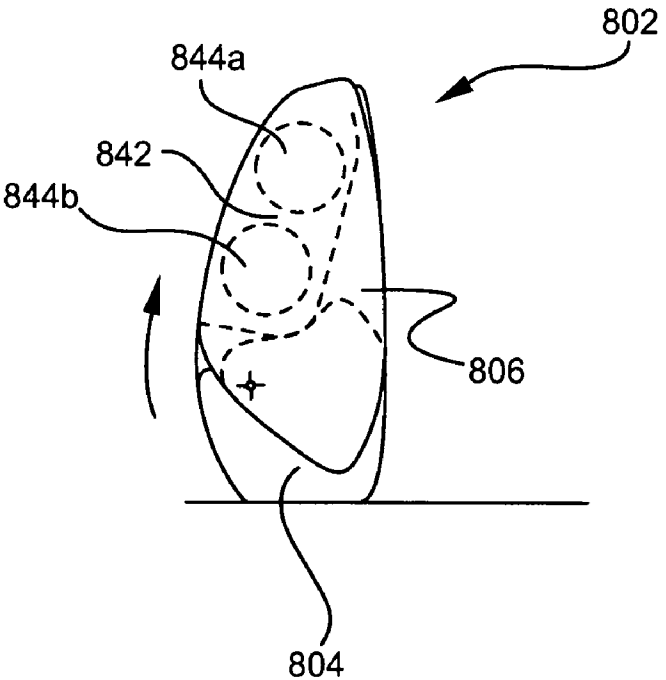
FIG. 8C is a side cross-sectional view of the vacuum appliance of FIG. 8A shown in the storage position taken along line C-C thereof.
Figure 8B:
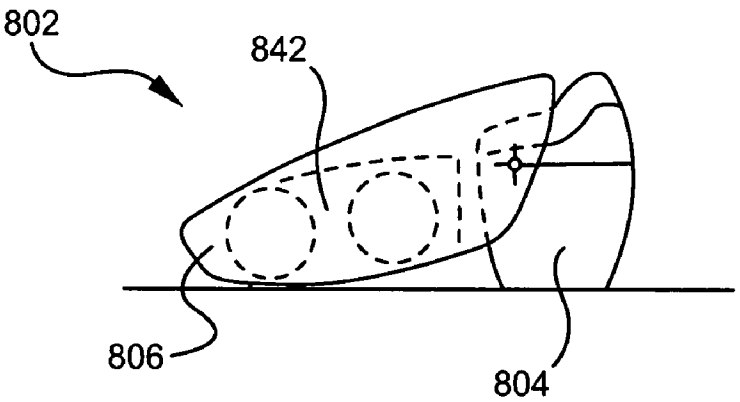
FIG. 8B is a side cross-sectional view of the vacuum appliance of FIG. 8A shown in the operating position taken along line C-C thereof.

One of the differences between vacuum packaging apparatus 602 and vacuum packaging apparatus 802 is that the movable receptacle component 806 is operable to house a dual bag roll shelf 842 as shown in FIGS. 8B and 8C. Dual roll shelf 842 can hold two rolls 844*a* and 844*b* of storage bags. Further, vacuum packaging apparatus 802 has two bag-cutting units 815*a* and 815*b* (FIG. 8A) since the apparatus can hold two rolls of storage bags. As shown in FIGS. 8B and 8C the receptacle may be rotated about an axis between a flipped-up storage position (FIG. 8C) and a flipped-down operating position (FIG. 8B).

Figure 9B:
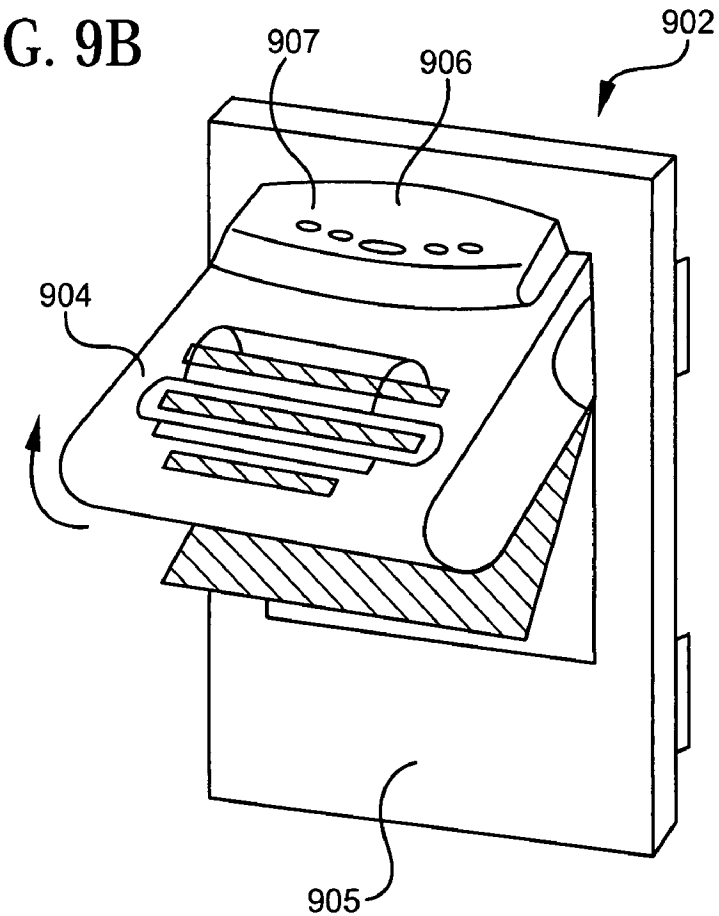
FIG. 9B is a perspective view of the vacuum appliance of FIG. 9A in an operating mode for a wall or cabinet.
Figure 9A:
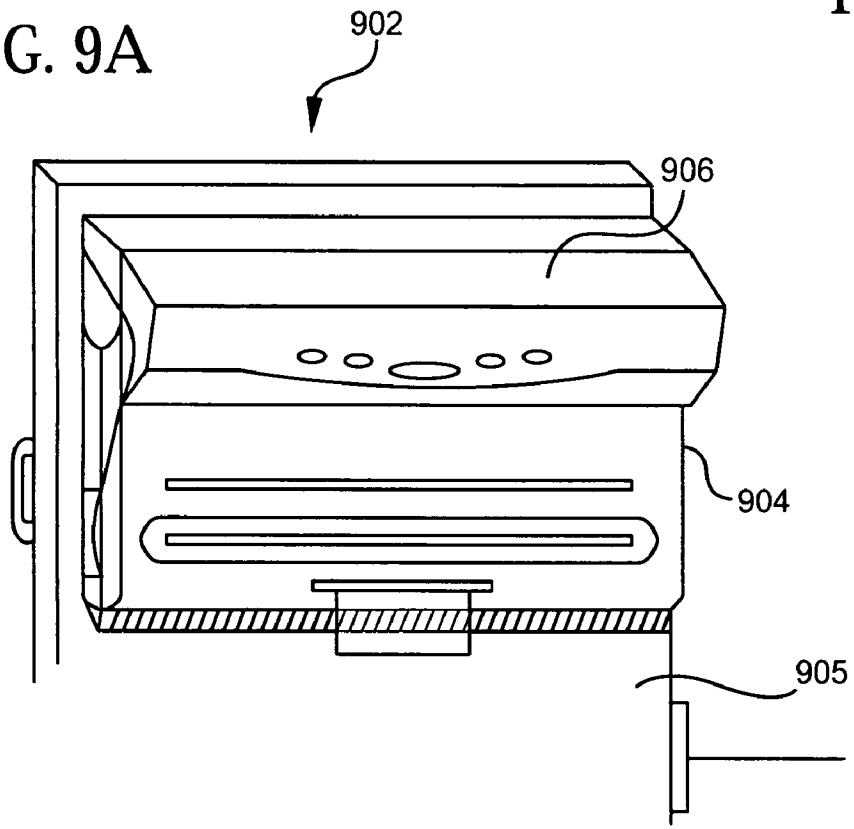
FIG. 9A is a perspective view of a further embodiment of a vacuum appliance in storage mode for a wall or cabinet.

FIGS. 9A and 9B illustrate a frontal isometric view of a vacuum appliance 902 for a wall or cabinet. FIGS. 9A and 9B show a vacuum appliance 902 affixed to a cabinet door or to a wall 905. Vacuum appliance 902 includes a movable receptacle component 904 and a fixed component 906. Fixed component 906 may include a control panel 907 including similar features as those described with respect to FIG. 6A. Receptacle component 904 may be pivoted up away from wall 905, i.e., flipped-up, about a pivot axis that runs the length of fixed component 906. Movable receptacle component 904 is flipped up when in operating mode as shown in FIG. 9B. FIG. 9A shows vacuum appliance 902 in a storage mode. In this configuration, movable receptacle component 904 may be pivoted down against wall 905. In other words, vacuum appliance 902 is flipped-down for convenient storage (idle storage mode). Vacuum appliance 902 can be a lidless vacuum appliance.

In the foregoing specification, embodiments of the invention have been described with reference to numerous specific details that may vary from implementation to implementation. The specification and drawings are, accordingly, to be regarded in an illustrative rather than a restrictive sense.

What is claimed is:

1. An apparatus for vacuum sealing a storage bag comprising:

a base having a surface engagable with a work surface for supporting the apparatus thereon;

a receptacle including an opening in communication with a vacuum source for receiving an open end of a storage bag, the receptacle including a bottom portion selectively engagable with the work surface, the receptacle being pivotally secured to the base and rotatable relative thereto between a first position wherein the receptacle surface is supported on the work surface and a second position wherein the receptacle bottom portion is supported by the base above the work surface.

2. An apparatus for vacuum sealing a storage bag comprising:

a base engagable with a work surface for supporting the apparatus thereon;

a receptacle including a lid and a housing, the lid being movably secured to the housing and moveable between an open and closed position, the lid and housing adapted to receive therebetween an end of a storage bag, the receptacle including a vacuum chamber defined by the lid and the housing for accepting an open end of the bag, the receptacle being pivotally secured to the base and rotatable relative thereto between a first operating position and a second storage position; and a sealing device disposed on the receptacle for sealing the open end of the bag.

3. The apparatus as defined in claim 2, wherein the receptacle rotates about a pivot axis which runs along the length of the base.

4. The apparatus as defined in claim 2, wherein the receptacle extends outwardly from the base in a generally horizontal direction when the receptacle is in the first position, and extends in a generally vertical direction when the receptacle is in the second position.

5. The apparatus as defined in claim 2, wherein the base has a width transverse to its longitudinal axis, and the receptacle does not extend beyond the width of the base when in the second position.

6. The apparatus as defined in claim 2, wherein the vacuum chamber includes a vacuum channel adapted to communicate with a vacuum generating device.

7. The apparatus as defined in claim 6, wherein the vacuum channel runs along a length of the receptacle.

8. The apparatus as defined in claim 6, wherein the sealing device includes a heat sealing strip extending along the front of the vacuum channel.

9. The apparatus as defined in claim 2, wherein the receptacle includes a gasket for sealing the vacuum chamber.

10. The apparatus as defined in claim 2, wherein the base is supportable on a generally vertical surface, and the receptacle is disposed generally parallel to the vertical surface when in the first position and generally perpendicular to the surface when in the second position.

11. The apparatus as defined in claim 2, wherein the lid selectively covers the vacuum chamber.

12. The apparatus as defined in claim 2, wherein the lid is secured in a closed position by a latch.

13. The apparatus as defined in claim 2, wherein the base includes controls adapted to control the operation of a vacuum mechanism.

14. The apparatus as defined in claim 2, wherein the base includes an accessory vacuum port.

15. The apparatus as defined in claim 2, wherein the receptacle includes a bag storage compartment adapted to hold a roll of bag material.

16. The apparatus as defined in claim 15, wherein the bag storage compartment is adapted to hold two rolls of bag material.

17. The apparatus as defined in claim 2, wherein the receptacle includes a bag cutting device.

18. The apparatus as defined in claim 2, further including a mechanism for preventing operation of the apparatus when the receptacle is in the second position.

19. The apparatus as defined in claim 2, further including a vacuum channel disposed on the receptacle housing and extending along at least a portion of a length thereof, the channel being covered by the lid when the lid is in the closed position.

20. The apparatus as defined in claim 2, wherein the base has a width transverse to its longitudinal axis, and the receptacle extends beyond the width of the base in the first position and the receptacle remains substantially within the width of the base when in the second position.

21. The apparatus as defined in claim 2, wherein the vacuum chamber extends along a length of the receptacle and the vacuum chamber receives therein the end of the storage bag.

22. An apparatus for vacuum sealing a storage bag comprising:

a stationary base for supporting the apparatus on a work surface;

a receptacle adapted to receive an end of a storage bag, the receptacle including a vacuum chamber for accepting an open end of the bag, the receptacle including a bag storage compartment adapted to hold a roll of bag material, the receptacle being pivotally secured to the base and rotatable relative thereto between a first operating position and a second storage position; and a sealing device disposed on the receptacle for sealing the open end of the bag.

23. An apparatus for vacuum sealing a storage bag comprising:

a base having a width transverse to its longitudinal axis;

a receptacle including a lid and a housing, the lid being movably secured to the housing and moveable between an open and closed position, the lid and housing adapted to receive therebetween an end of a storage bag, the receptacle being pivotally secured to the base and rotatable relative thereto between a first operating position wherein the receptacle extends in a generally horizontal direction beyond the width of the base and a second storage position wherein the receptacle extends from the base in a generally vertical direction; and a sealing device disposed on the receptacle for sealing the open end of the bag.

24. The apparatus as defined in claim 23, wherein the receptacle is disposed generally within the width of the base when in the second position.

* * * * *